United States Patent [19]

Orlomoski

[11] 3,930,425

[45] Jan. 6, 1976

[54] METHOD FOR MANUFACTURING CONTOURED THREAD ROLLING DIES

[75] Inventor: Roger W. Orlomoski, Holden, Mass.

[73] Assignee: Litton Industrial Products, Inc., Holden, Mass.

[22] Filed: Jan. 6, 1975

[21] Appl. No.: 538,890

Related U.S. Application Data

[62] Division of Ser. No. 430,800, Jan. 4, 1974, Pat. No. 3,896,653.

[52] U.S. Cl. ..... 76/107 R; 90/11.42

[51] Int. Cl.[2] ..... B21K 5/20

[58] Field of Search ..... 76/101 B, 107 R; 90/11.42, 90/11.48

[56] References Cited

UNITED STATES PATENTS 2,197,732 4/1940 Olson ..... 76/107 R

*Primary Examiner*—Al Lawrence Smith
*Assistant Examiner*—James G. Smith
*Attorney, Agent, or Firm*—Joseph R. Spalla

[57] ABSTRACT

This invention relates to dies and the method for making dies for rolling threaded fasteners having conical or truncated conical ends. The face of each of a pair of dies which contacts the workpiece includes a first generally planar surface having a plurality of parallel ridges disposed thereon. A second generally planar surface having ridges thereon for threading the conical or truncated conical end is disposed on the face at an angle with respect to the first generally planar surface. The face on which the two generally planar surfaces are disposed is normally generally rectangular and elongated in the direction of relative movement between a pair of dies. The intersection of the two generally planar surfaces and each groove or ridge disposed on each such surface is positioned in parallel realtionship to every other ridge or groove and the intersection of the first and second generally planar surfaces. Each ridge disposed in a plane which is parallel to the first plane and the projection is disposed at an angle with respect to the direction of movement which is substantially equal to the helix angle of the threaded fastener to be formed. These angular relationships permit the rapid and inexpensive manufacture of dies for threaded fasteners of the type described by enabling cutting or grinding of the entire face with a multipoint cutting tool or a crushed grinding wheel in a single pass as opposed to prior art structures which necessitated the use of single point cutting tools or correspondingly shaped grinding wheels which machined or ground a single groove between adjacent ridges in each machining pass.

6 Claims, 4 Drawing Figures

METHOD FOR MANUFACTURING CONTOURED THREAD ROLLING DIES

This is a division of application Ser. No. 430,800, filed Jan. 4, 1974 now U.S. Pat. No. 3,896,653.

BACKGROUND OF THE INVENTION

The thread rolling process has been widely accepted as a means of forming external threads accurately, quickly and inexpensively. Production rates have reached six hundred parts per minute. The product so manufactured has superior physical qualities to that produced by machining. Significant material savings are realized since a blank is utilized having an outside diameter which is less than the outside diameter of the threaded fastener to be formed. This invention relates primarily to flat dies for such thread rolling processes and particularly to dies for rolling those threaded fasteners which have both a straight section and a point section. Other applications may include planetary dies for the rolling of such dies.

Such dies have been relatively expensive to manufacture because of the necessity of making multiple passes either with a grinding wheel or a milling cutter to individually produce each groove. The individual machining or grinding has been necessary because the face surface of the die which contacted the workpiece comprises two generally planar surfaces; the first generally planar surface disposed on the face of the die in substantially parallel relationship to the axis of the straight section of the workpiece and the second generally planar surface also disposed on the face of the die which contacts the workpiece. As viewed from one end of the die, the angular relationship between the two generally planar surfaces is equal to the angle between the straight section and point section of the finished screw.

The intersection of the first and second generally planar surfaces defined a line parallel to the direction of relative movement between the pair of dies utilized to form a single screw. Because the ridges disposed on the first and second generally planar surfaces of the face are obliquely disposed with respect to the intersection of the first and second generally planar surfaces, each ridge in the first generally planar surface was disposed in the same plane as the intersection of the first and second generally planar surfaces, which is sometimes referred to as the heel line, and each ridge is disposed at an angle to the direction of movement substantially equal to the helix angle of the thread to be rolled. Each ridge on the second generally planar surface is an extension of a ridge on the first generally planar surface. It is not feasible to use a multipoint cutter or grinding wheel to simultaneously generate all of the ridges in this configuration because the multipoint tool, as it progresses obliquely with respect to the heel line, will generate grooves of unequal depth if any attempt is made to obliquely pass over the "heel line."

The single point tools which have been typically utilized are controlled by means of cams or other mechanical apparatus to follow a predetermined rise and fall path which imparts a contoured thread forming surface into the die working face. The number of milling cuts or grinding cuts that must be made in single point generation of the die working face is determined by the length and pitch of the thread which is to be rolled by the die being made.

It is apparent that the mechanism for imparting the described rise and fall path, as well as the time involved in repetitively cutting each individual groove while describing the referred to rise and fall path, results in a relatively expensive manufacturing process.

SUMMARY OF THE INVENTION

It has now been found that the various problems with the prior art may be avoided in dies for forming the circumference of a substantially cylindrical workpiece into a threaded fastener having a tapered portion. Dies in accordance with the invention have a face elongated in the direction of movement cooperating with a similar face on another die upon relative motion therebetween. Each die face has a first planar surface disposed substantially parallel to the substantially cylindrical portion of the workpiece and has substantially parallel ridges disposed thereon at an included angle with respect to the direction of movement substantially equal to the helix angle of the threaded fastener to be rolled. Each die face has a second generally planar surface which intersects the first generally planar surface to define a line substantially parallel to said ridges on said first generally planar surface. The second generally planar surface also has ridges disposed thereon which are also substantially parallel to each of the ridges on the first generally planar surface.

In one form, the face may include a relief for clearance of an axial portion of the workpiece as it is started along the face and also may include a cutoff ramp gradually rising from the first generally planar surface which fairs into said second generally planar surface.

The invention also contemplates the method of manufacturing a die for rolling a threaded fastener having a tapered end portion wherein the die is provided with a plurality of ridges disposed in first and second generally planar surfaces intersecting to define a line disposed at an included angle with respect to the direction of movement when the die is used substantially equal to the helix angle of the screw to be formed with such die. The method includes holding the die blank and traversing a single multiple ridged tool along the face of the die blank with the line of contact between the tool and the die being disposed with respect to the direction of movement, when the die is used, at an angle equal to ninety degrees minus the helix angle of the screw to be rolled with the die. All of the thread rolling ridges on the die are accordingly manufactured simultaneously. In a preferred form, the tool is a grinding wheel manufactured by a crush grinding process to have a face complimentary to the desired die form. In another form, the method of manufacturing the die comprises holding the die blank and traversing a single tool having multiple ridges thereon along the face of the die blank with a line of contact between the tool and the die being disposed at right angles to the line which defines the intersection of the first and second generally planar surfaces.

It has been found that the invention meets the objects of the invention which include providing a die and a method for manufacturing a die which is compatible with existing thread rolling machines and which is substantially less expensive to manufacture.

Another object of the invention is to produce a die and a method for manufacturing such a die wherein the accuracy of the contour is improved by simultaneously machining each ridge and each groove of the die.

Still another object of the invention is to provide a die and a method for manufacturing such a die wherein different contours on individual ridges may be produced simultaneously such as where self-tapping or self-locking threads are desired.

DETAILED DESCRIPTION OF THE ILLUSTRATED EMBODIMENT

Figure 1:
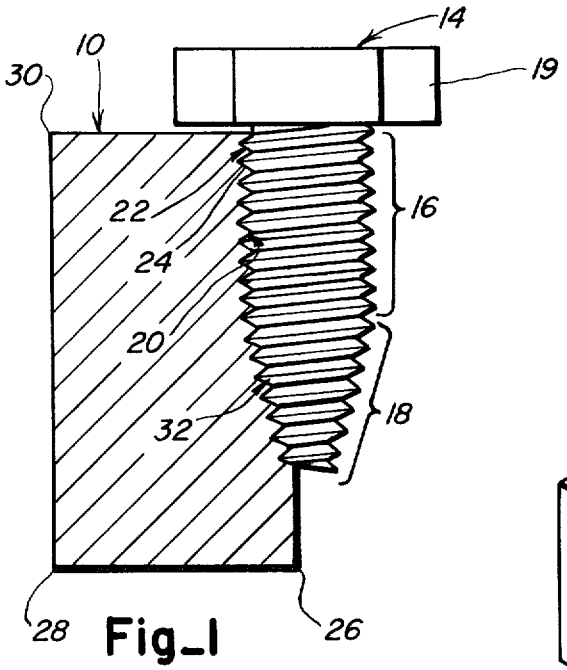
FIG. 1 is a sectional view illustrating a thread rolling die and a threaded fastener produced thereby in accordance with the invention.
Figure 2:
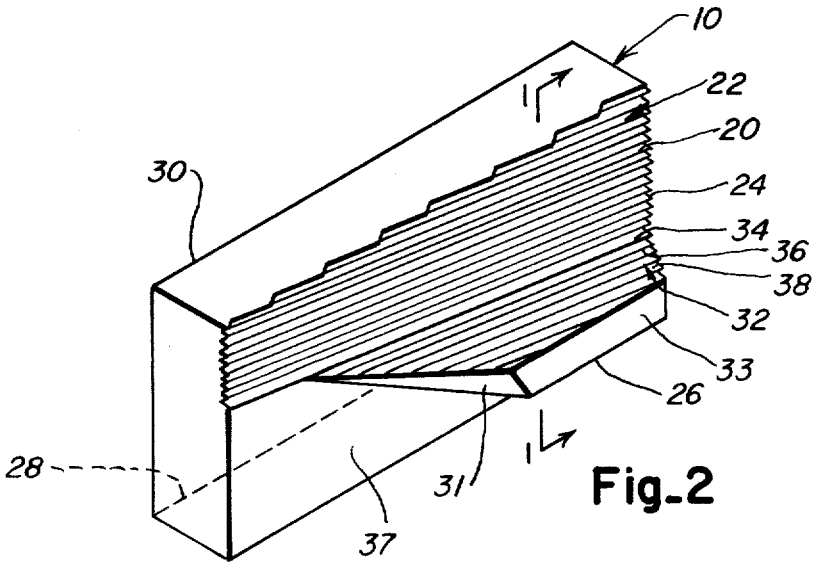
FIG. 2 is an isometric view to a slightly reduced scale of the die shown in FIG. 1 and showing the position of section 1—1 taken therein.

Turning now in detail to FIGS. 1 and 2 of the drawing, therein illustrated is a short die 10 embodying the present invention and having a plurality of discrete surfaces, each of which is adapted to operating in conjunction with a corresponding surface of another die (not shown) to vary the form of a blank or workpiece to produce a threaded fastener or workpiece 14 having a cylindrical body portion 16, a tapered end portion 18 and a head 19. As is customary in such dies, there is an exact counterpart having an identical shape and size on the mating die for every portion of the illustrated die except for the end portions which in one of the dies will be somewhat elongated. The longer of the two dies is provided with extensions which typically may be ¼ of 1 inch on each end. The extensions are provided for end-wise adjustment purposes. The discrete transverse surfaces of die 10 correspond to the discrete surfaces of threaded fastener 14 which are cylindrical body portion 16 and tapered end portion 18.

A first generally planar surface 20 is disposed on the working face of the die 10 which contacts the workpiece 14. It is disposed in generally parallel relationship to the axis of the workpiece 14. Also, in the customary manner, it is provided with a plurality of ridges 22 spaced between grooves 24. Each ridge 22 and each groove 24 is disposed in parallel relationship to every other ridge 22 or groove 24 within the first planar surface 20.

Customarily, the die 10 will be manufactured with three parallel edges which are identified by the numerals 26, 28 and 30. In operation, there will be relative motion between the workpiece 14 and the die 10 and specifically the die will move in a direction parallel to each of the sides 26, 28 and 30. This relationship is not necessary to the invention and is noted merely because it conforms to the conventional method of manufacturing dies. It will be understood by those skilled in the art also that in a conventional flat die thread rolling machine that only one of the two dies in a pair is moved while the other is held stationary and a workpiece is passed therebetween. Accordingly, the terminology "direction of movement" pertains specifically to the die in the pair of dies that is being moved. Each of the ridges 22 and grooves 24 in the first generally planar surface 20 is disposed at an angle with respect to the direction of movement of the die which is substantially equal to the helix angle of the screw which is to be formed by the die. In the illustrated embodiment, it will be evident that the ridges 22 and grooves 24 are also disposed at an angle with respect to edges 26, 28 and 30 which is substantially equal to the helix angle of the screw to be rolled with the die.

A second generally planar surface 32 on the working face of the die 10 is obliquely disposed with respect to first generally planar surface 20 and is particularly for the purpose of rolling threads on the tapered end portion 18 of the workpiece 14. As measured in a transverse cross-section, perpendicular to the direction of movement of the die 10, the angle between the first generally planar surface 20 and second generally planar surface 32 will be substantially equal to the angle defined on the screw by the lines which are respectively defined by the crests of the screw threads within cylindrical body portion 16 and tapered end portion 18. The second generally planar surface 32 is disposed also with respect to first generally planar surface 20 so that the intersection therebetween defines a line 34 which is sometimes referred to as the heel line. This heel line 34 is parallel to each ridge 22 and each groove 24 on first generally planar surface 20. It will be understood that although reference has been made to the plane defined by the ridges 22 and the plane defined by grooves 24 that the distance therebetween is so small that the two may be reasonably considered to be one single plane with the understanding that a rigorous geometric analysis must properly consider that they are in fact separate planes. The generally planar surface 32 is provided with a plurality of ridges 36 and grooves 38 for forming threads in the tapered end portion 18 of the workpiece 14. For threaded fasteners, such as that shown in FIG. 1, which are sometimes referred to as CA fasteners, it is preferable to provide die 10 with a relief or clearance surface 31 which is faired into second generally planar surface 32 and also a second relief or clearance surface 33. A constraint surface 37 is also provided to limit the radial growth of the workpiece 14 as it is moved with respect to the die 10 and promote axial extrusion of excess metal away from the head of the threaded fastener 14 which might otherwise increase the diameter of the rolled thread profile. The axial extrusion of excess metal is attained by the cooperation of constraint surface 37 with a corresponding surface on the mating die (not shown). By promoting the passage of portions of the workpiece 14, inordinate buildup between the planar surface 20 and the corresponding surface on the mating die is prevented. The two complementary dies are disposed in spaced relationship during the rolling operation. Normally, the constraint surface 37 will be disposed parallel to the plane defined by the uppermost portion of ridges 22 and approximately midway between the ridges 20 and grooves 24.

Figure 3:
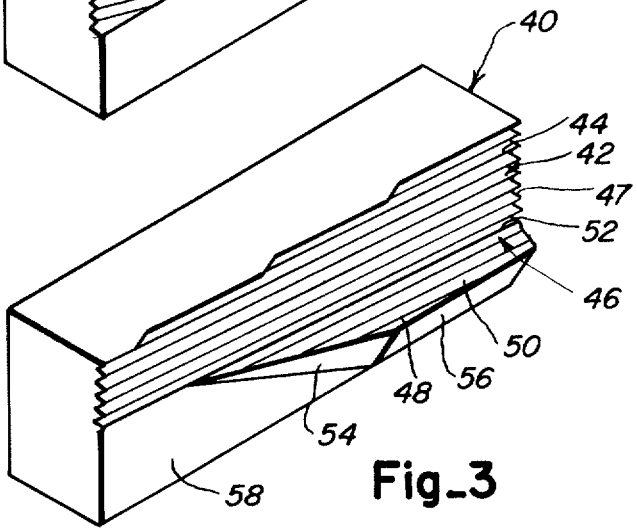
FIG. 3 is an isometric view of a cutoff die for forming gimlet point screws in accordance with the invention.

Referring now to FIG. 3, therein illustrated is a die 40, similar to that shown in FIGS. 1 and 2 which differs in that it is of the cutoff type meaning that it is structured to accommodate a cylindrical blank or workpiece to form a gimlet point threaded fastener and sever a finite axial portion of the workpiece. The die 40 includes a first generally planar surface 42 corresponding to first generally planar surface 20 shown in FIG. 2. It will be understood that for some gimlet point screws the generally planar surface 42 will not be parallel to the axis of the workpiece 14, and that there accordingly will be some taper along axially spaced portions of the resulting threaded fastener. This is in contrast to the first generally planar surface 20 shown in FIG. 2 which is disposed substantially parallel to the axis of the workpiece 14. The first generally planar surface 42 is provided with ridges 44 and grooves 47 which are disposed in parallel relationship and at the helix angle with respect to the direction of movement as in the die 10. A second generally planar surface 46 is also provided corresponding to second generally planar surface 32 in die 10 which also has ridges 48 and grooves 50 disposed in the manner corresponding to that of the ridges 36 and grooves 38 of second generally planar surface 32 on die 10. The angle between the first generally planar surface 42 and second generally planar surface 48 as measured in a transverse cross-section perpendicular to the direction of movement is again substantially equal to the angle between the lines defined by respectively the crests of the threads on the finished screw on the body portion and on the pointed end portion. The intersection of first and second generally planar surfaces 42 and 46 defines a line 52 which is parallel to each ridge 44, 48 and each groove 47, 50. In accordance with the conventional construction, the die 40 is provided also with a cutoff ramp 54 which is faired into the second generally planar surface 46 as well as a clearance surface 56 for the purpose of avoiding interference with the cooperating die (not shown). A relief area 58 is also provided to allow clearance for an axial portion of the workpiece prior to forming, threading and cutting off the tip of the cylindrical workpiece.

Figure 4:
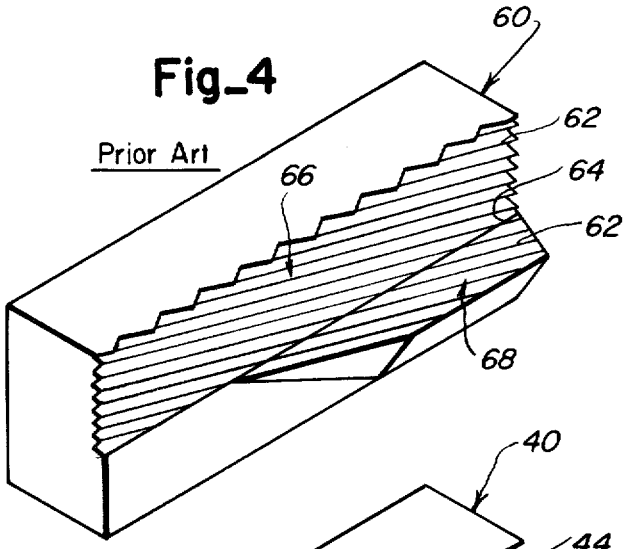
Fig 4 Prior Art
FIG. 4 is an isometric view of a die in accordance with the prior art showing the relationship between the ridges on the faces of a cutoff die and the intersection of the generally planar surfaces respectively for threading the cylindrical body portion of the fastener and the tapered portion of the threaded fastener.

Referring now to FIG. 4, there is illustrated a die 60 in accordance with the prior art. The critical difference therebetween is clearly evident in these views in that the ridges 62 are not parallel to the heel line 64 and that the heel line 64 is not disposed at an angle substantially equal to the helix angle of the screw to be rolled with respect to the direction of movement of the die 60. This difference makes it impossible to simultaneously machine each ridge 62 with one cutting or grinding tool having axially spaced machining elements. This follows because of the necessity for moving the cutter for each individual ridge or groove between pairs of ridges up and down sequentially in different phased relationship as machining progresses from the first generally planar surface 66 to the second generally planar surface 68. By contrast, the die of FIG. 3 may be manufactured merely by holding the die blank and passing a multipoint tool which may be a crushed grinding wheel or multipoint tool over the surface to be machined. With blanks having some preforming, this may be done in one traverse. Secondary milling operations are then necessary in the case of die 40 to produce the clearance surface 56, cutoff ramp 54 and relief 58.

It will be observed by those skilled in the art that although the invention has been described with respect to a flat die, that it also may be utilized in the construction of planetary dies. In the method of manufacture of such dies the die blank may be moved with respect to the machining tool instead of holding the die stationary and moving the tool.

It will be seen that the die and method of manufacturing die produce a product which is compatible with existing thread rolling machines at a cost which, because of the simplification of the manufacturing process, is substantially less than dies heretofore utilized. In some applications, it may be desirable to preform the workpiece simultaneously with the header operation to produce the optimum quality of threaded fastener. Similarly, it will be evident that all ridges and grooves on the die may be machined simultaneously which will promote greater accuracy in the finished die product as well as in the threaded fasteners which are produced thereby, as well as reducing the cost of the dies involved. Increased accuracy with respect to the ridges and grooves is possible because (1) the crush ground roller or multipoint cutting tool can economically be manufactured with low dimensional tolerance since it will be used repetitively and (2) the process of using a single point cutter is inherently more accurate than the repetitive cam controlled rise and fall path process for milling each groove. It is also apparent that different ridge configurations may be simultaneously manufactured across the face of the die for rapidly producing dies to manufacture threads having self-tapping or self-locking characteristics.

What I claim is:

1. The method of manufacturing a die for rolling a threaded fastener having a tapered end portion, said die having a working face defined by a first and a second generally planar surface, said first and second planar surfaces intersecting along a line disposed at an included angle with respect to the direction of movement when the die is used substantially equal to the helix angle of the screw to be formed with such die which comprises: angle of the screw to be formed with such die which comprises:

holding the die, and traversing a single tool having multiple ridges thereon relative to the face of the die with the line of contact between the tool and the die being disposed with respect to the direction of movement when the die is used at an angle equal to ninety degrees minus the helix angle of the screw to be rolled with the die to simultaneously cut a plurality of parallel thread forming ridges in said first and second planar surfaces.

2. The method as described in claim 1, wherein the tool comprises a grinding wheel having a crush ground contour complimentary to said working face.

3. The method as described in claim 1, wherein the tool comprises a multipoint cutting tool having a contour complimentary to said working face.

4. The method of manufacturing a die for rolling a threaded fastener having a tapered end portion, said die having a working face defined by a first and a second generally planar surface, said first and second planar surfaces intersecting along a line disposed at an included angle with respect to the direction of movement when the die is used substantially equal to the helix angle of the screw to be formed with such die which comprises:

holding the die, and traversing a single tool having multiple ridges thereon relative to the face of the die, the line of contact between the tool and the die being disposed at an angle of ninety degrees with respect to the line defined by the intersection of the first and second generally planar surfaces to simultaneously cut a plurality of parallel thread forming ridges in said first and second planar surfaces.

5. The method as described in claim 4, wherein the tool comprises a grinding wheel having a crush ground contour complimentary to said working face.

6. The method as described in claim 4, wherein the tool comprises a multipoint cutting tool having a contour complimentary to said working face.

* * * * *

UNITED STATES PATENT AND TRADEMARK OFFICE

CERTIFICATE OF CORRECTION

PATENT NO. : 3,930,425

DATED : January 6, 1976

INVENTOR(S) : Roger W. Orlomoski

It is certified that error appears in the above-identified patent and that said Letters Patent are hereby corrected as shown below:

In The Specification:

Column 4, line 58, after "ridges" change "20" to --22--.
Column 5, line 48, after "die" change "of" to --in--.

In The Claims:

Column 6, claim 1, lines 29-30, after "which comprises:", delete "angle of the screw to be formed with such die which comprises:".

Signed and Sealed this

*twenty-seventh* Day of *April 1976*

[SEAL]

*Attest:*

RUTH C. MASON
*Attesting Officer*

C. MARSHALL DANN
*Commissioner of Patents and Trademarks*